US006764242B1

(12) United States Patent
Karten et al.

(10) Patent No.: US 6,764,242 B1
(45) Date of Patent: Jul. 20, 2004

(54) MOLDED BINDER HAVING WINDOWS AND POCKETS

(75) Inventors: Stuart Karten, Venice, CA (US); Dennis Schroeder, Hermosa Beach, CA (US); Paul Kirley, Venice, CA (US); Eric Olson, Venice, CA (US); Norman Yamamoto, Yorba Linda, CA (US); Arthur G. Castillo, Chino Hills, CA (US); Robert Fey, Anaheim Hills, CA (US); Donald W. Finkle, Yorba Linda, CA (US)

(73) Assignee: Avery Dennison Corporation, Pasadena, CA (US)

( * ) Notice: Subject to any disclaimer, the term of this patent is extended or adjusted under 35 U.S.C. 154(b) by 0 days.

(21) Appl. No.: 09/717,653

(22) Filed: Nov. 21, 2000

(51) Int. Cl.[7] ..... B42F 13/00

(52) U.S. Cl. ..... 402/73; 281/15.1; 281/29; 402/4; 402/80 R; 402/502; D19/26

(58) Field of Search ..... 402/3, 4, 70, 73, 402/80 R, 80 P, 502; D19/26, 27; 281/15.1, 29, 31, 36, 37, 38

(56) References Cited

U.S. PATENT DOCUMENTS

| | | | | | |
|---|---|---|---|---|---|
| 4,571,109 | A | * | 2/1986 | Lapertosa | 402/15 |
| 4,907,823 | A | * | 3/1990 | Windish | 281/31 |
| 5,711,627 | A | * | 1/1998 | Chapman | 281/29 |
| 5,857,797 | A | * | 1/1999 | Streff et al. | 281/31 |
| 5,876,143 | A | * | 3/1999 | Ong | 281/29 |
| 5,951,189 | A | * | 9/1999 | Winzen | 281/29 |
| 6,017,164 | A | * | 1/2000 | Abbott | 281/29 |
| 6,019,540 | A | * | 2/2000 | Senior | 281/15.1 |
| 6,168,338 | B1 | * | 1/2001 | Young | 281/29 |
| 6,241,414 | B1 | * | 6/2001 | Wien | 281/20 |
| 6,305,714 | B1 | * | 10/2001 | Rossetto et al. | 281/29 |
| 6,367,842 | B1 | * | 4/2002 | Wien et al. | 150/145 |
| 6,368,005 | B1 | * | 4/2002 | Streff et al. | 281/29 |
| 6,390,712 | B1 | * | 5/2002 | Urness | 402/4 |
| 2002/0041789 | A1 | * | 9/2001 | Conklin et al. | 402/73 |

* cited by examiner

*Primary Examiner*—Monica S. Carter
(74) *Attorney, Agent, or Firm*—Fulwider Patton Lee & Utecht LLP

(57) ABSTRACT

A binder assembly and manufacturing process thereof includes a front cover, a back cover, a spine, and openings in the assembly for the purpose of placing windows inside the front cover and spine. The front cover, back cover and spine define the space for holding loose-leaf pages. The openings in the front cover and spine define the space for placing loose papers into the front cover and spine. Pockets are included on the inside of the binder assembly for securing additional loose-leaf papers. Manufacturing processes of the binder assembly include methods in which the same material is used for all components and in which different materials are used to manufacture various components in the same process.

47 Claims, 10 Drawing Sheets

MOLDED BINDER HAVING WINDOWS AND POCKETS

BACKGROUND OF THE INVENTION

The present invention relates to a binder. Specifically, the invention relates to a binder having a first transparent window within a front cover of the binder and a second transparent window within a spine of the same binder.

DESCRIPTION OF THE RELATED ART

A binder is generally designed to hold loose documents between its covers. These documents can be easily removed and the binder can be reused for subsequent storage of other documents. Binders may have rings on the inside for securely holding the loose documents. The spine of a binder may be a solid member to which rings of latching mechanisms may be attached for the purpose of holding papers. Binders may be formed from a relatively flexible material or a relatively stiff material. The front and back covers may be interconnected to the spine through a flexible coupling allowing for easy opening and closing.

Binders may also have interior and exterior pockets for carrying or storing loose sheets of paper. For example, the exterior pockets may be formed from a flexible material that allows for easy storage and removal of papers indicating a particular use for the binder on the spine or on the front cover. Over time these pockets become stretched from storage of paper and lose their ability to properly hold documents in their place. Such pockets may also be easily damaged. They therefore become unable to hold loose documents in place.

Interior pockets are used to store additional documents or other items. These pockets may also be made from a flexible material. Like exterior pockets, over time the material becomes stretched and loses its ability to provide a secure place for storage. Once stretched or damaged, these pockets also become unable to hold papers or other items in place.

There is therefore a need for a binder assembly that provides a user with the ability to adequately store loose papers for a long period of time. There is a further need for a binder with pockets that will not become stretched or damaged from use and therefore unable to hold loose documents. There is also a need for a system in which the binder and its contents can be easily identified. There remains a need for a binder assembly with is aesthetically pleasing and also rugged and capable of being economically produced on a large scale.

SUMMARY OF THE INVENTION

The present invention provides a binder that allows for the storage of documents. One aspect of the present invention is to provide a way for users to identify the contents of a binder. This is accomplished by placing transparent plastic windows inside the front cover of the binder and/or inside the spine of the binder. A pocket may be placed on the inside of the front cover for holding a piece of paper against the front cover window. Another pocket may be placed on the inside of the spine for holding a piece of paper against the spine window. The combination of pockets and windows provides a convenient way to identify the contents of a binder for future use and reference.

Another aspect of the present invention is to provide a manufacturing process that efficiently produces a binder with embedded windows and interior pockets for holding loose papers. In one embodiment, this may be accomplished by using the same process for producing the binder and the windows for the cover and spine. In this process each binder may be subjected to only one pass through a production process. The windows are formed first from a material that is different from that of the actual binder assembly. The material for the binder assembly may be injected around the windows, forming the binder parts. The windows may then be coupled to the binder assembly.

Another aspect of the present invention is to provide a production process in which the binder assembly may be injection molded using a first material. In one embodiment, the respective windows for the openings in the front cover and spine may be formed from a second material and embedded into the respective openings of the front cover and spine. The process of embedding occurs by sliding the windows into the openings such that they become part of the front cover and spine, respectively. The windows are then secured or coupled to the front cover and spine. Accordingly, this aspect of the present invention also provides a method of coupling the windows to the binder where the material used for the binder is different from that of the windows.

Yet another aspect of the present invention is to manufacture binders with the same material used for the binder and for the windows. Manufacturing a binder using only one material for both the binder assembly and for the windows involves only one pass through the manufacturing process.

DETAILED DESCRIPTION OF THE PREFERRED EMBODIMENTS

Figure 1:
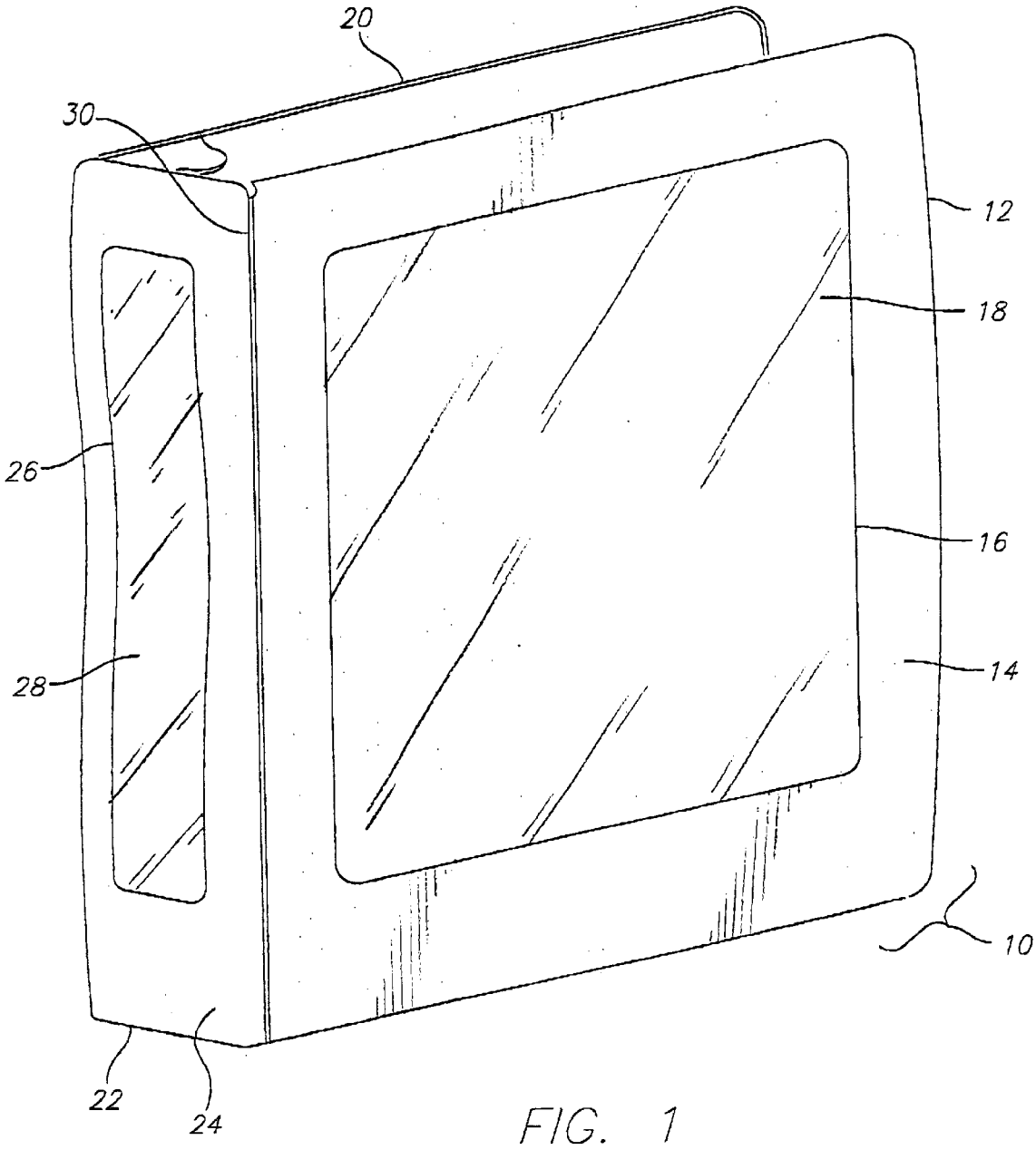
FIG. 1 is an external view of the binder assembly from the front cover side.

In FIG. 1, a front cover assembly 12 of a binder assembly 10 includes an outside 14 and a first opening 16. The first opening 16 is substantially covered by a first window 18. The binder assembly 10 also includes a back cover 20 and a spine 22. The spine 22 has an outside 24 and a second opening 26. The spine 22 is placed between the front cover assembly 12 and the back cover 20. The spine 22 hingeably couples the front cover assembly 12 to the back cover 20. In one embodiment, a living hinge 30 performs the coupling of the front cover assembly 12 to the spine 22. The living hinge 30 may be made of the same material as that which is used to form the binder. The living hinge 30 also couples the spine 22 to the back cover 20. Moreover, a second window 28 substantially covers the second opening 26 in the spine 22.

Figure 2:
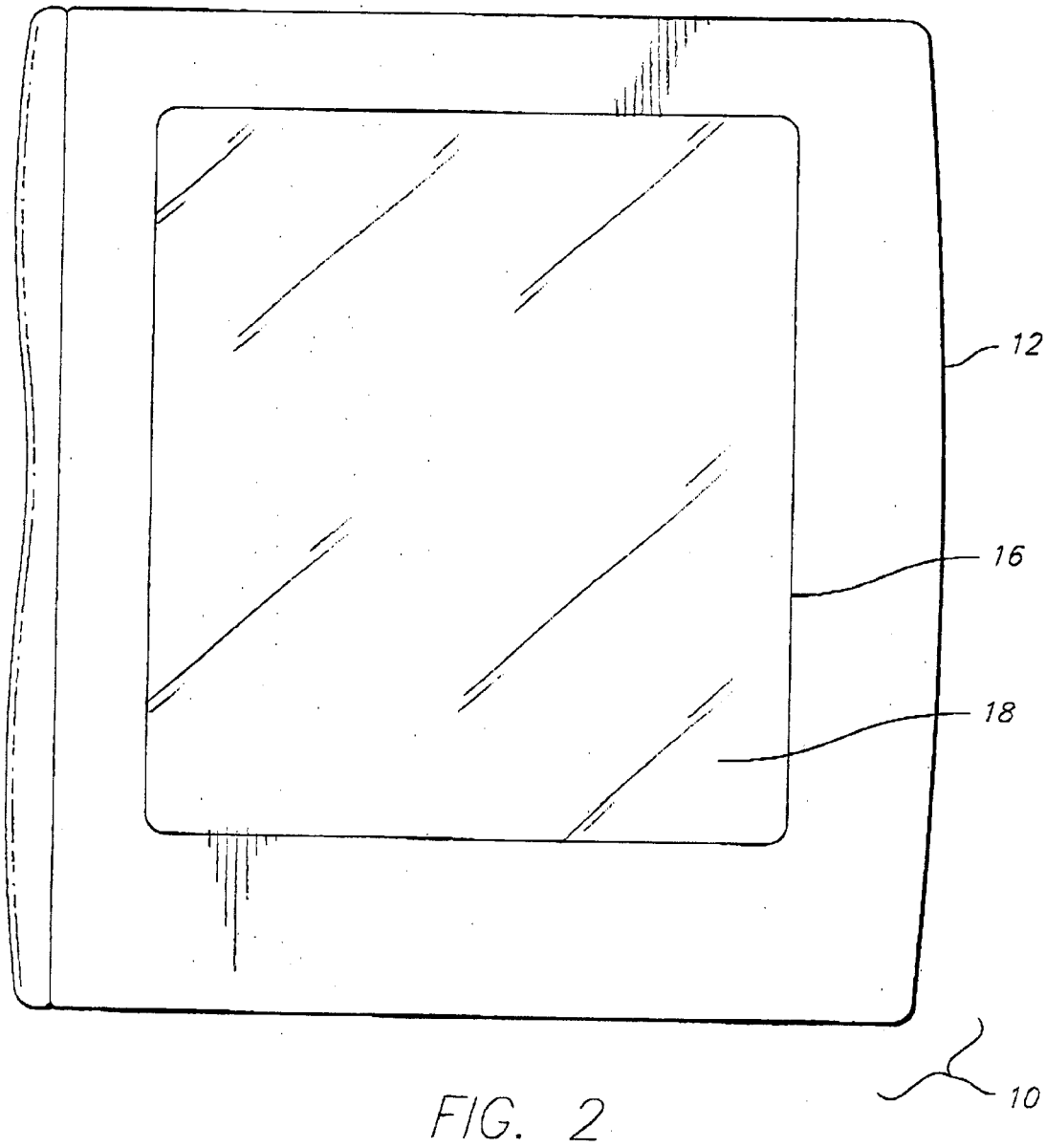
FIG. 2 is an external view of the binder assembly from the front cover side and showing only the front cover.

FIG. 2 shows the outside of the front cover assembly 12 of the binder assembly 10. In one embodiment of the invention, the first window 18 may be thought of as a backing layer with a top and a bottom. The backing layer substantially covers the first opening 16 in the front cover assembly 12 and may be coupled to the front cover assembly 12.

Figure 3:
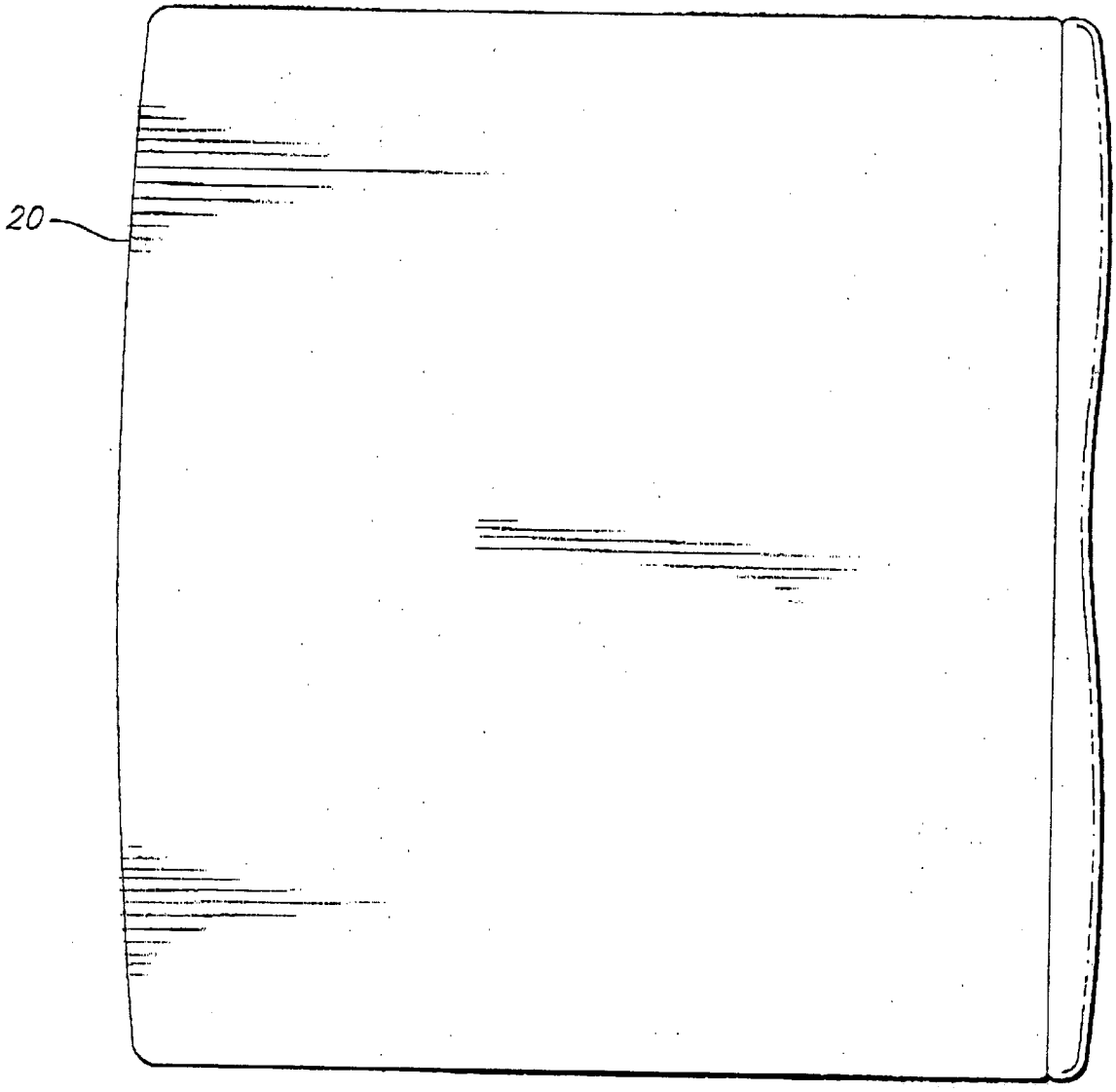
FIG. 3 is an external view of the binder assembly showing only the back cover.

FIG. 3 shows the back cover 20 of the binder assembly 10. In one embodiment of the invention, the back cover 20 includes an opening which may be substantially covered by an additional window. An additional pocket may also be included and coupled to the inside of the back cover 20 for securing insertions against the additional window. This additional pocket may allow for insertions from the top, the side, or the bottom.

Figure 4:
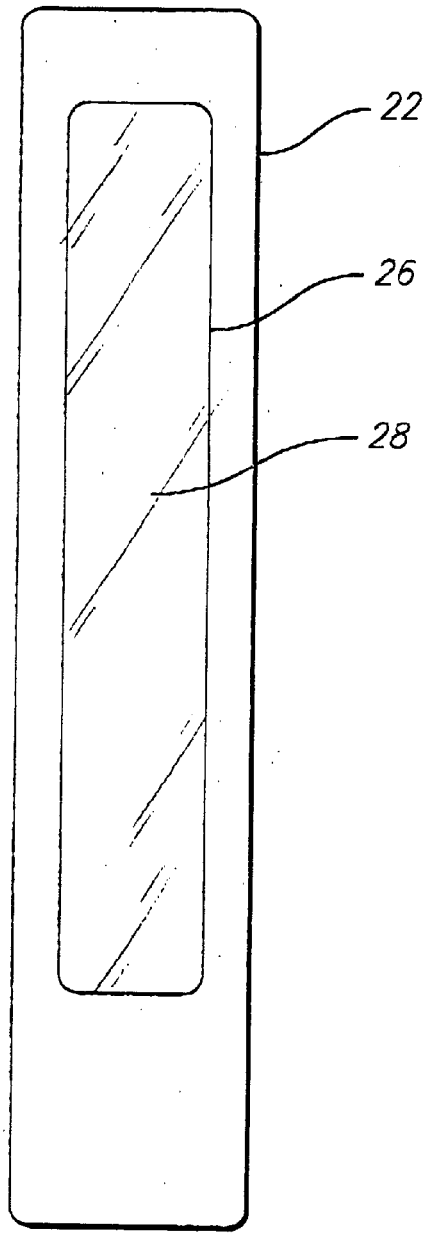
FIG. 4 is an external view of the binder assembly showing only the outside of the spine.
Figure 5:
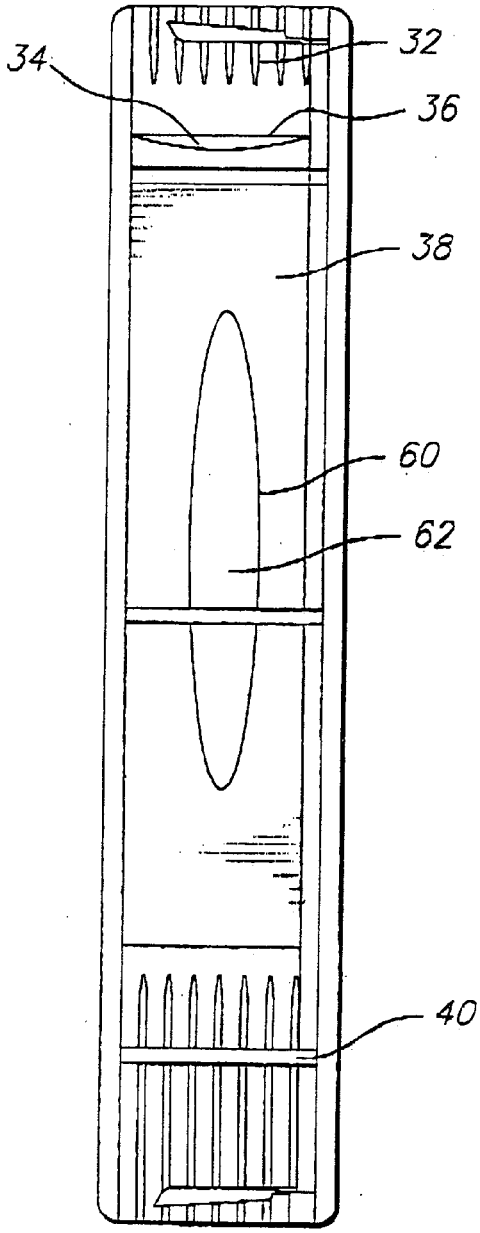
FIG. 5 is an internal view of the binder assembly showing the inside of the spine.

FIGS. 4 and 5 show the outside of the spine 22 and the inside of the spine 22, respectively. In one embodiment, the second window 28 may be a backing layer substantially covering the second opening 26 in the spine 22 and coupled to the spine 22. FIG. 5 illustrates by way of example the inside of the spine 22. FIG. 5 shows a flanged lip 32, an opening 34 at the top 36, and a second pocket 38. Also shown is a center 60 and a hole 62 in the second pocket 38. A ring portion 40 is also illustrated in FIG. 5.

Figure 6:
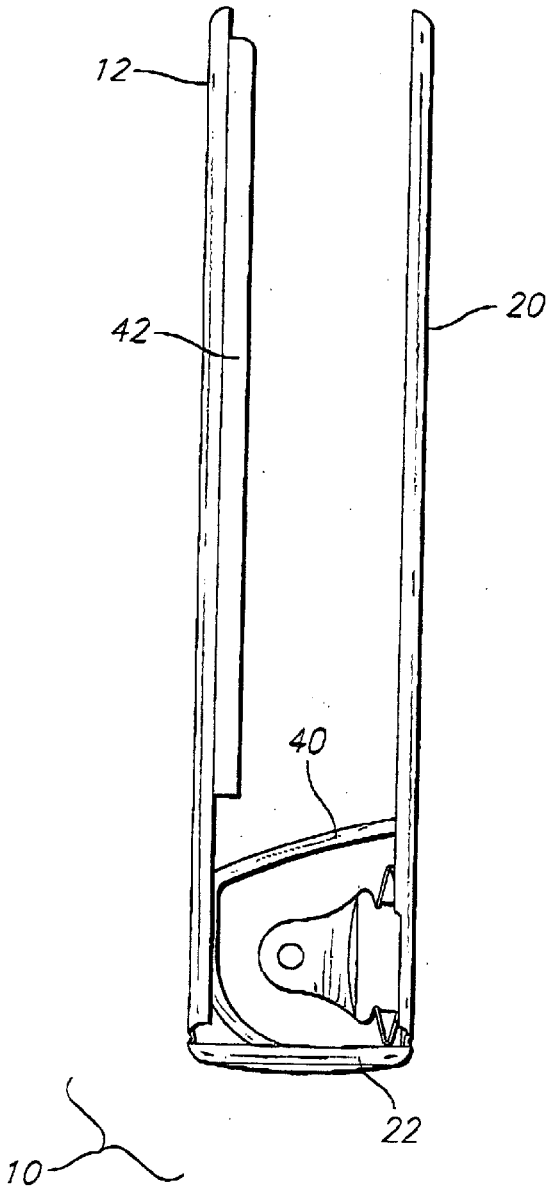
FIG. 6 is a side view of the binder assembly viewed from its bottom, showing the ring portion and displaying the interior compartment in the front cover.
Figure 7:
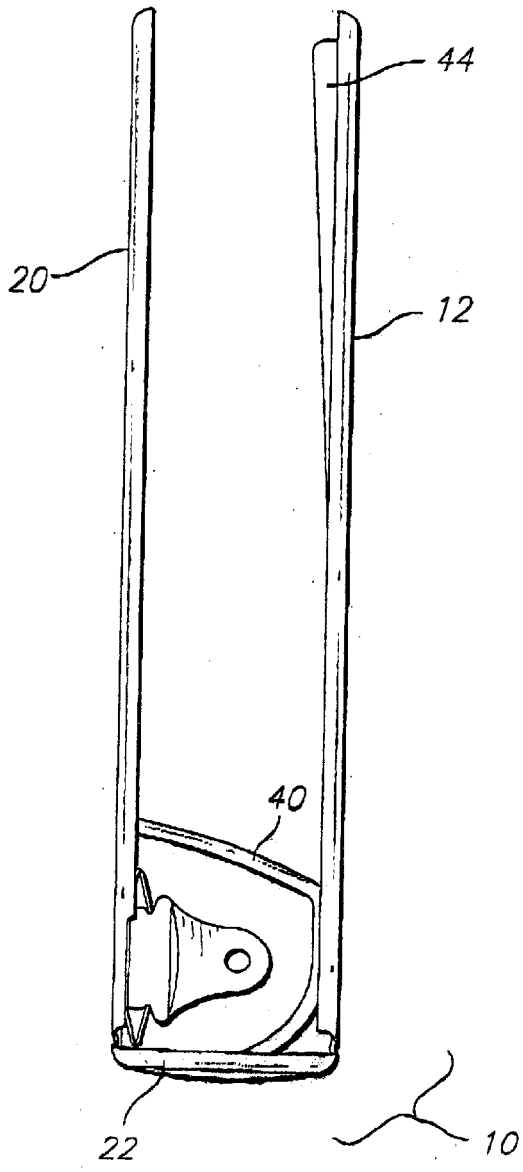
FIG. 7 is a side view of the binder assembly viewed from its top, showing the ring portion and displaying the interior compartment in the front cover.

FIGS. 6 and 7 show bottom and top side views of the binder assembly 10. FIG. 6 illustrates the binder assembly 10 as viewed from its bottom. The interior compartment 42 is shown coupled to the front cover assembly 12. The spine 22 is also shown, as is the back cover 20 and the ring portion 40. FIG. 7 illustrates the binder assembly 10 as viewed from its top. An intermediate pocket 44 is shown coupled to the front cover assembly 12. Also shown is the back cover 20, the spine 22 and the ring portion 40.

Figure 8:
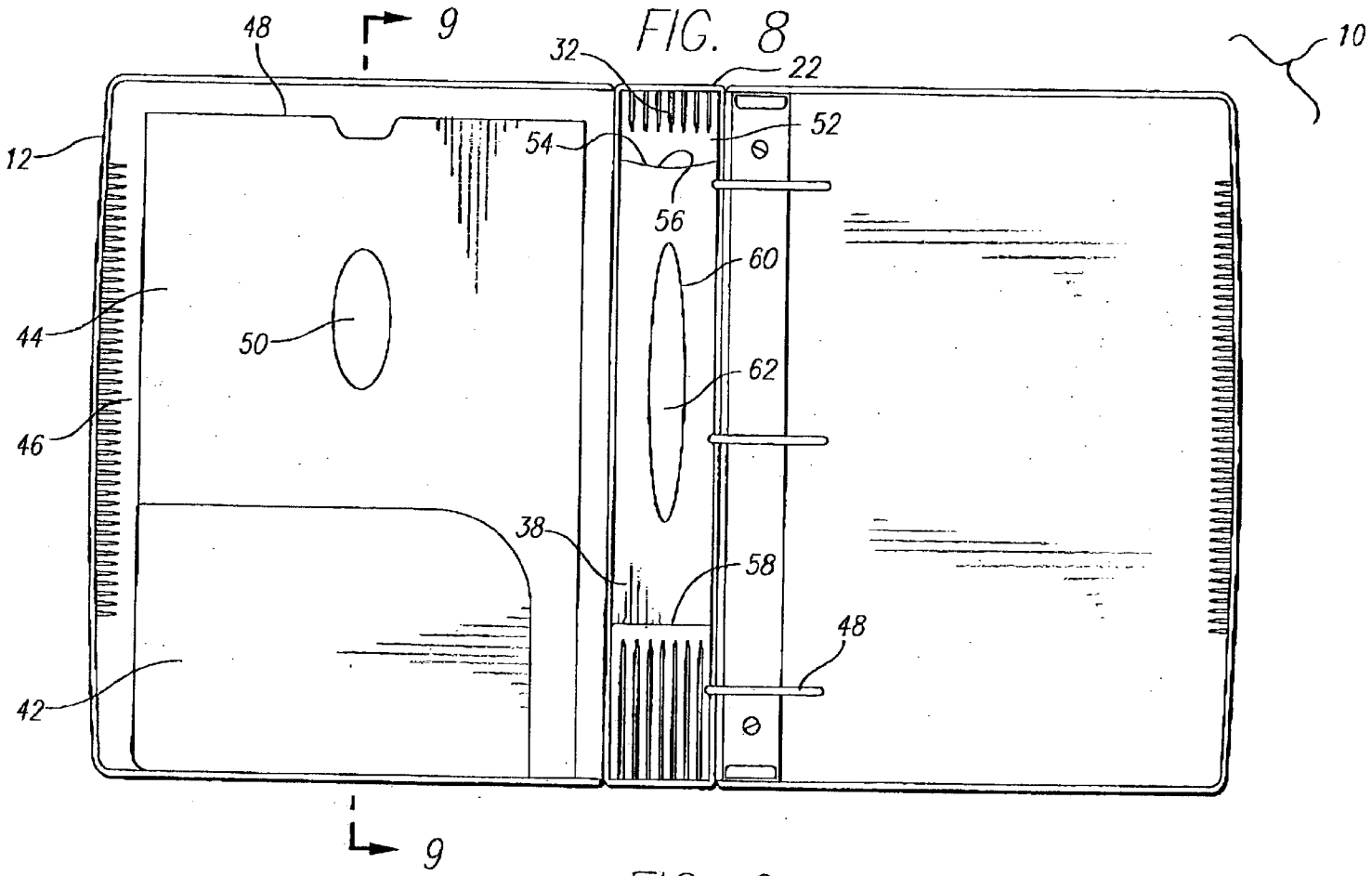
FIG. 8 is an internal view of the binder assembly showing the interior of the front cover, spine, and back cover.

As shown in FIG. 8, the binder assembly 10 includes an interior compartment 42 coupled to an inside 46 of the front cover assembly 12. In one embodiment, the interior compartment 42 may be molded to the inside 46 of the front cover assembly 12. The molding of the interior compartment 42 may occur during the manufacturing process for the present invention. The interior compartment may additionally be coupled to the front cover assembly in several other ways. For example, the interior compartment may be mechanically fastened onto the front cover assembly using teeth to hold the pocket in place. In another embodiment, interlocking teeth may be used to mechanically fasten the interior compartment to the front cover assembly. In still another embodiment, the interior compartment may be ultrasonically welded to the front cover assembly. A further embodiment provides for the interior compartment to be heat welded to the front cover assembly. The interior compartment may also narrow to securely position insertions such that the interior compartment appears concave relative to the front cover assembly. That is, the gap between the interior compartment and the front cover may become closer from the top to the bottom of the front cover. The interior compartment may be made of the same material as the binder assembly, or from a different material as well. In one embodiment, the interior compartment may be a film pocket that may be coupled to the front cover assembly using any of the methods described above.

An intermediate pocket 44 may also coupled to the front cover assembly 12 and located between the first window and the interior compartment 42, regardless of the method used to coupled the interior compartment 42. The intermediate pocket 44 may be coupled to the front cover assembly in several ways. For example, the same method as described above for the interior compartment to the front cover may be used. Of course, any method known to one skilled in the art may be used as well. The intermediate pocket 44 may also be a film pocket coupled to the front cover assembly. The intermediate pocket 44 may also narrow to securely position insertions such that the intermediate pocket appears concave relative to the front cover assembly.

The intermediate pocket 44 of the front cover assembly 12 may have an opening at a top 48 allowing for an insert to be placed in the pocket. The intermediate pocket 44 may also have an opening located at the side of the pocket, allowing for an insert to be placed from the side. Either side of the pocket may have such an opening. The intermediate pocket 44 may also have an opening at the bottom of the pocket allowing for an insert to be placed in the pocket from the bottom. The intermediate pocket 44 may also have a hole 50 allowing for easy placement and removal of insertions in the pocket.

In another embodiment, the front cover assembly 12 may have an upper opening and a lower opening. An upper window may substantially cover the upper opening. A lower window may substantially cover the lower opening. In this embodiment, the intermediate pocket 44 may include an upper pocket and a lower pocket for securing insertions against the upper and lower windows. Each pocket may also have openings on the top, bottom and side allowing for placement of insertions against the upper and lower windows.

A second pocket 38 may be coupled to an inside 52 of the spine 22. The second pocket 38 may also include a top 54 with an opening 56 at the top 54 and a flanged lip 32. In another embodiment, the flanged lip 32 is located at the bottom of the spine 22. The second pocket 38 may also include a bottom 58 and a center 60. The second pocket may also narrow toward the bottom 58 to hold items securely. In another embodiment, the second pocket 38 may curve toward the bottom 58 to hold items securely. The second pocket 38 may additionally have a hole 62 in the center 60 for ease of sliding a loose paper into and out of the second pocket 38. Moreover, the flanged lip 32 lifts the loose paper as it is pushed towards the flanged lip 32 so that it is easy to grab the loose paper and remove it from the second pocket. In one embodiment, the second pocket 38 also has an opening in the bottom 58 allowing for the placement of an insertion from the bottom. The second pocket 38 may be made of the same material as the binder assembly, and it may be made of different materials as well.

In one embodiment, the interior compartment 42 may be a film pocket. The second pocket 38 may be coupled to the spine 22 in several ways. In one embodiment, the second pocket 38 may be mechanically fastened onto the spine 22 using teeth to hold the pocket in place. In another embodiment, interlocking teeth may be used to mechanically fasten the second pocket 38 to the spine 22. In still another embodiment, the second pocket 38 may be ultrasonically welded to the spine 22, while a further embodiment provides for heat welding as the method of coupling the second pocket 38 to the spine 22.

Referring further to FIG. 8, the invention may also include a ring portion 40 located on the inside 52 of the spine 22. In one embodiment, the ring portion 40 may be coupled to the inside 52 of the spine 22 or on the inside of the back cover. The ring portion 40 may include any number of rings for holding loose papers in place inside the binder assembly.

Figure 9:
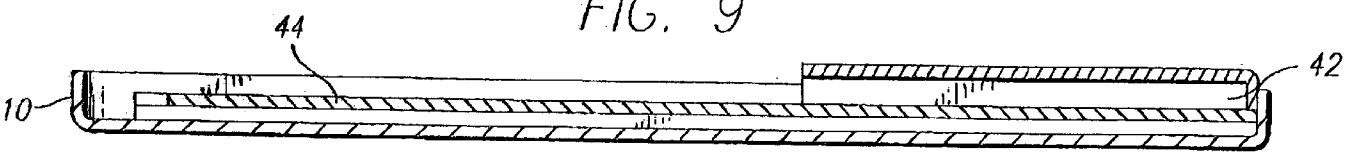
FIG. 9 is a cross-sectional side view of the front cover of the binder assembly.

FIG. 9 illustrates a cross-sectional side view of the front cover assembly 12. An interior compartment 42 may be molded to the front cover assembly in FIG. 9. The intermediate pocket 44 may be placed between the interior compartment 42 and the front cover assembly 12. The interior compartment 42 may be made of a rigid plastic to allow for tightly securing loose-leaf documents or other materials that are not placed inside the ring portion of the binder assembly 10. The intermediate pocket 44 may be situated such that it may tightly secure papers placed against the first window.

Figure 10:
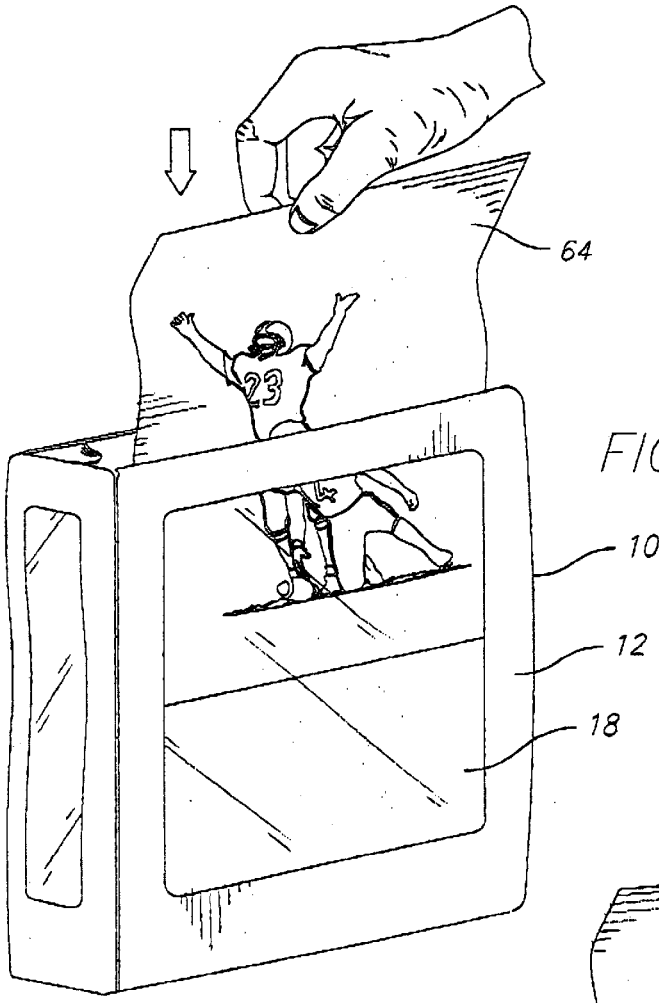
FIG. 10 is an outside view of the binder assembly showing only the front cover and spine, in which the first window in the front cover is shown holding a paper.
Figure 11:
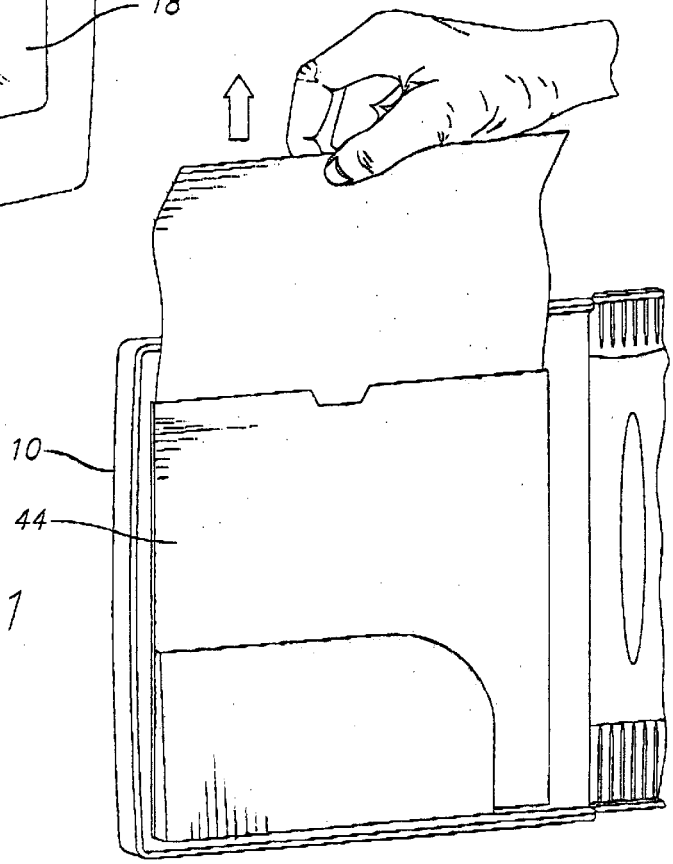
FIG. 11 is an inside view of the front cover and spine of the binder assembly only, in which the intermediate pocket is shown holding a paper.

FIG. 10 shows the binder assembly 10 with a first insert 64 placed between the front cover assembly 12 and an intermediate pocket such that the first insert 64 can be seen through the first window 18. Similarly, FIG. 11 illustrates by way of example the inside of the front cover assembly 12 and the placement of the first insert into the intermediate pocket 44. As with the drawing of FIG. 10, the first insert may be placed such that it can be seen from the outside of the front cover assembly 12 through the first window.

Figure 12:
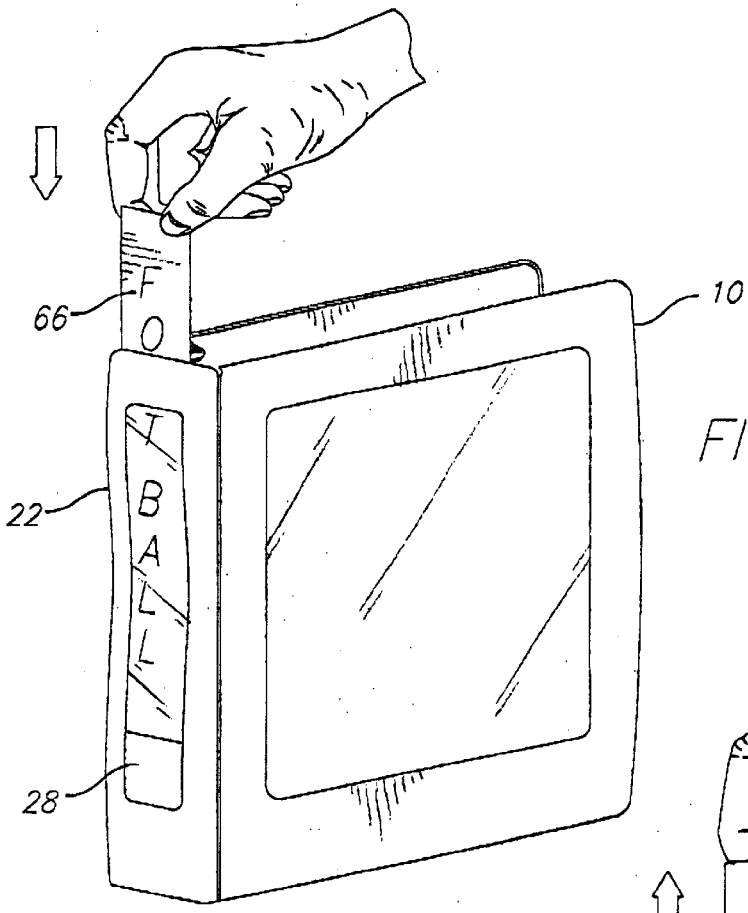
FIG. 12 is an outside view of the binder assembly showing only the front cover and spine, in which the second window in the spine is shown holding a paper.
Figure 13:
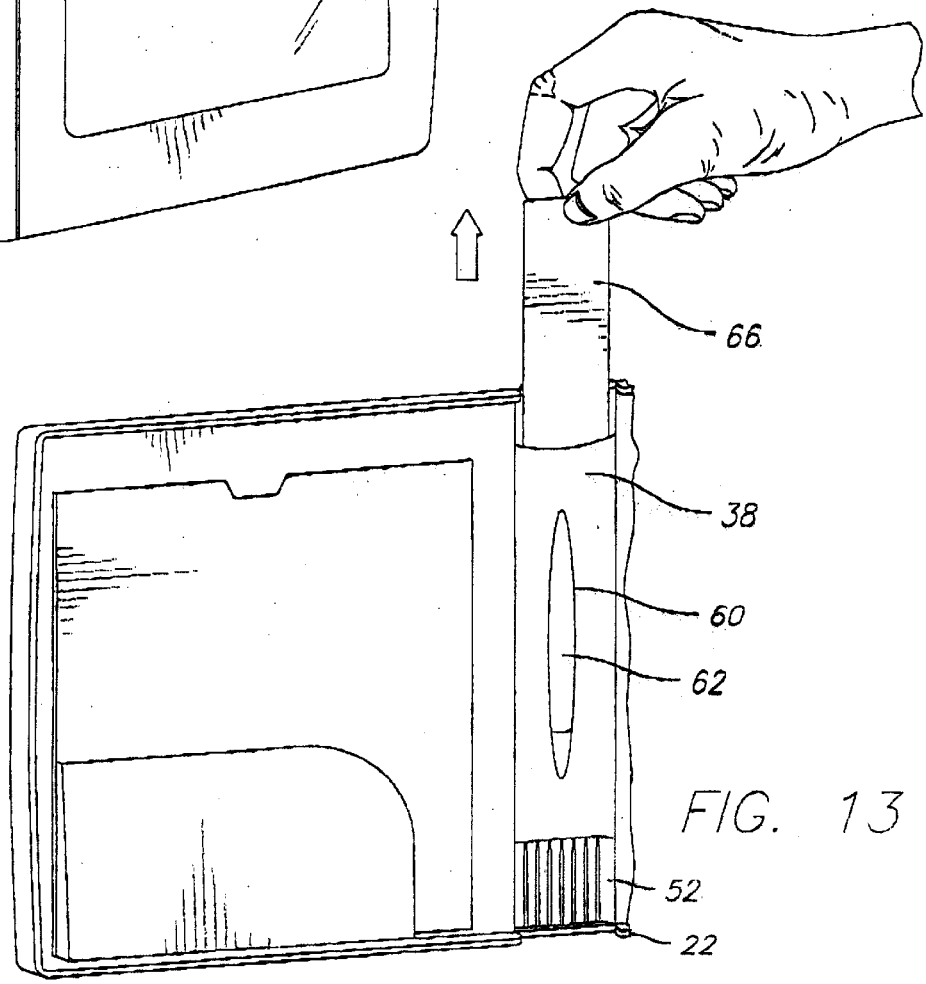
FIG. 13 is an inside view of the front cover and spine of the binder assembly only, in which the spine pocket is shown holding a paper.

Figure shows the binder assembly 10 with a second insert 66 placed between the spine 22 and the second pocket such that the second insert 66 can be seen through the second window 28. Similarly, FIG. 13 illustrates by way of example the inside 52 of the spine 22 and the placement of the second insert 66 into the second pocket 38. As with the drawing in FIG. 12, the second insert may be placed in the second pocket 38 such that it can be seen from the outside of the spine 22 through the second window. The second pocket 38 may also have a center 60 with a hole 62. The presence of the hole 62 allows a user to easily insert and remove the second insert 66 by sliding through the second pocket 38.

Another aspect of the present invention involves a double-shot process for manufacturing a binder assembly. In one embodiment of this aspect of the invention, a first material is injected into a mold to a form a binder. The first material used in this process may be polypropylene or any other material capable of forming rigid and durable plastic parts. The first material may be injected into a mold automatically. The mold produces a binder having a front cover and a back cover, each cover having an inside and an outside. A spine is located between the front cover and the back cover facilitating a hinged coupling of the front and back covers. The hinged coupling is performed by a first hinge coupling the front cover to the spine and a second hinge coupling the back cover to the spine. These first and second hinges may be living hinges. A living hinge is formed of a thin material, for example plastic, which is both durable and allows for the binder cover to open and close easily. The living hinges may be made of the same material used to produce the binder. The living hinges may also be produced by the same manufacturing process, in which the material used (for example, polypropylene) may be thinner at the first and second hinges to allow for movement of the front cover and back cover.

The double-shot manufacturing process also includes embedding a first window into the front cover. The embedding may be performed by placing the first window inside the front cover such that it forms the center of the front cover. The first window may additionally comprise the entire middle section of the front cover such that the first window is visible through the outside of the front cover and the inside of the front cover. Similarly, the manufacturing process may include embedding a second window into the spine. The embedding of the second window into the spine may be performed in the same manner as that described previously for the first window and the front cover. In this aspect of the invention, the respective windows may then be coupled to the front cover and to the spine. The respective windows may be coupled using different methods. In one embodiment, the respective windows may be coupled using teeth mechanisms that hold the respective windows in place inside the front cover and inside the spine.

The first and second windows may be made of a different material from the material used to mold the binder. Materials used for the first and second windows may be materials capable of producing rigid plastic parts. An example of the material used to form the windows may be styrene that is sheeted to form a flat surface. The sheeted styrene may then be die-cut into a shape necessary for embedding within the front cover or spine. Other materials capable of producing rigid plastic parts may also be used in this process. For example, the material may be polypropylene, clarified polypropylene, polystyrene, acrylonitrile/butadiene/styrene terpolymer (ABS), or any other materials having similar qualities as polystyrene. Other materials may be used that have dissimilar characteristics from the materials used to make the binder, such as materials having different melting characteristics than polypropylene that are at the same time capable of producing a clear window. Example of these materials include acrylic, polycarbonates, or a material comprising a hybrid of acrylic and styrene.

The double-shot manufacturing process further includes forming a plurality of pockets from the same material described above used to form the binder. These pockets may include an interior compartment that may be molded to the inside of the front cover. A first pocket may also be coupled to the inside of the front cover and situated between the interior compartment and the first window. Note that the first pocket may be formed inside of the front cover even without the interior compartment.

A second pocket may also be included and coupled to the inside of the spine. The first pocket, interior compartment and second pocket may be coupled using several different methods of coupling. In one embodiment, heat welding may be used to couple to the binder assembly. In another embodiment, ultrasonic welding may be used to couple to the binder assembly. In still another embodiment, interlocking teeth may be used to couple to the binder assembly. It should be noted that the binder assembly may also utilize different coupling methods for each of the pockets.

A ring portion may be coupled to the binder assembly using the manufacturing process of the present invention. The ring portion, which may be made of metal, can be coupled to the inside of the spine. The ring portion may include any number of rings for securing loose-leaf materials.

Figure 15:
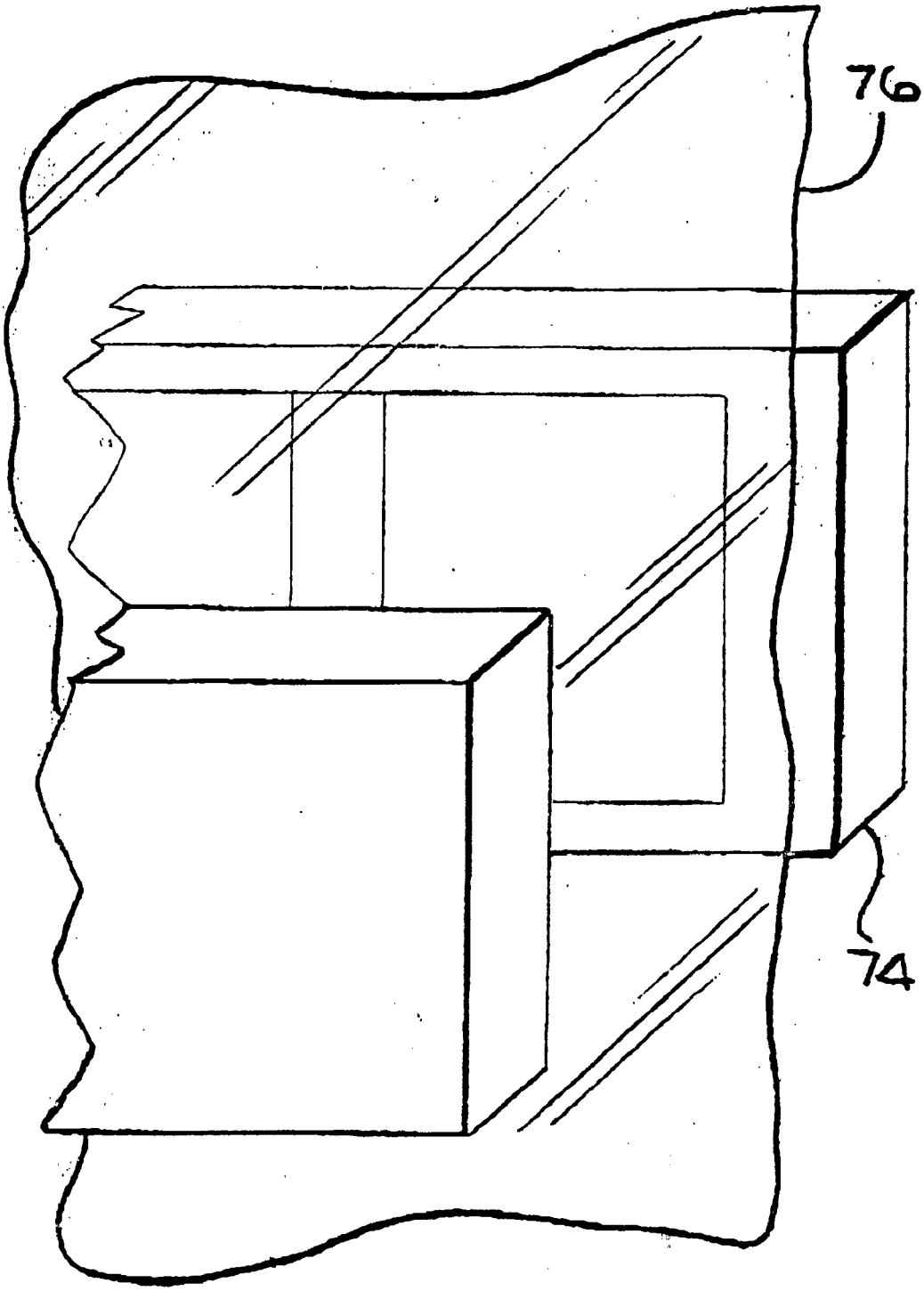
FIG. 15 is an in mold decoration method of coupling a window to a binder assembly.

It should be noted that an alternate embodiment of performing a double-shot manufacturing process exists. In this embodiment, the materials are film-molded to form the various components of the binder assembly, including all of the pockets, compartments, and windows. An example of the film molding the windows to the binder assembly is shown in FIG. 15 and described herein.

A second double-shot manufacturing process may be used to produce the binder assembly in another embodiment of the present invention. This embodiment differs from the process described above in that the order of forming the components of the present invention in the manufacturing process may be reversed. In this embodiment, a front cover window sheet and spine window sheet may be formed from a first material injected into a first mold. This material may be polystyrene or other material having similar qualities as polystyrene. Injection of the first material into a mold may occur automatically. A second material, which is also capable of forming a rigid plastic, may be injected into a second mold to form a binder. This material may be polypropylene or another material with similar characteristics. The second material may be injected into the binder mold automatically.

The binder mold may include a front cover and a back cover, each having an inside and an outside, and a spine situated between the front cover and the back cover. The spine hingeably connects to the front cover by a first hinge. The spine also hingeably connects to the back cover by a second hinge. The mold forming the binder may include a plurality of pockets formed from the second material used to form the binder. These pockets include an interior compartment molded to the inside of the front cover. The molding of the compartment may be performed during the double-shot manufacturing process. A first pocket may also be coupled to the inside of the front cover, situated between the interior compartment and the first window. A second pocket may also be included among the pockets manufactured. The second pocket is coupled to the inside of the spine. In another embodiment, the materials are film-molded to form the various components of the binder assembly, including all of the pockets, compartments, and windows.

A third double-shot manufacturing process may be used to produce the binder assembly of the present invention. In this embodiment, a first material is injected into a binder mold to form a binder portion. Injection of the first material into a mold occurs automatically. The first material is injected into a first window mold to form a first window. The first window substantially covers the first opening in the front cover. The first material is then injected into a second window mold to form a second window. The second window substantially covers the second opening in the spine. The first window is then coupled to the binder portion and the second window is coupled to the binder portion. A plurality of pockets may also be formed from the first material. These pockets include an interior compartment molded to the inside of the front cover and a first pocket coupled to the inside of the front cover and situated between the first window and the interior compartment. A second pocket may also be included that is coupled to the inside of the spine. In another embodiment, the materials are film-molded to form the various components of the binder assembly, including all of the pockets, compartments, and windows.

In another aspect of the present invention, a method of coupling the window assembly to the binder portion is contemplated. The window assembly includes a first window, a second window, a first window pocket, and a second window pocket.

Figure 14:
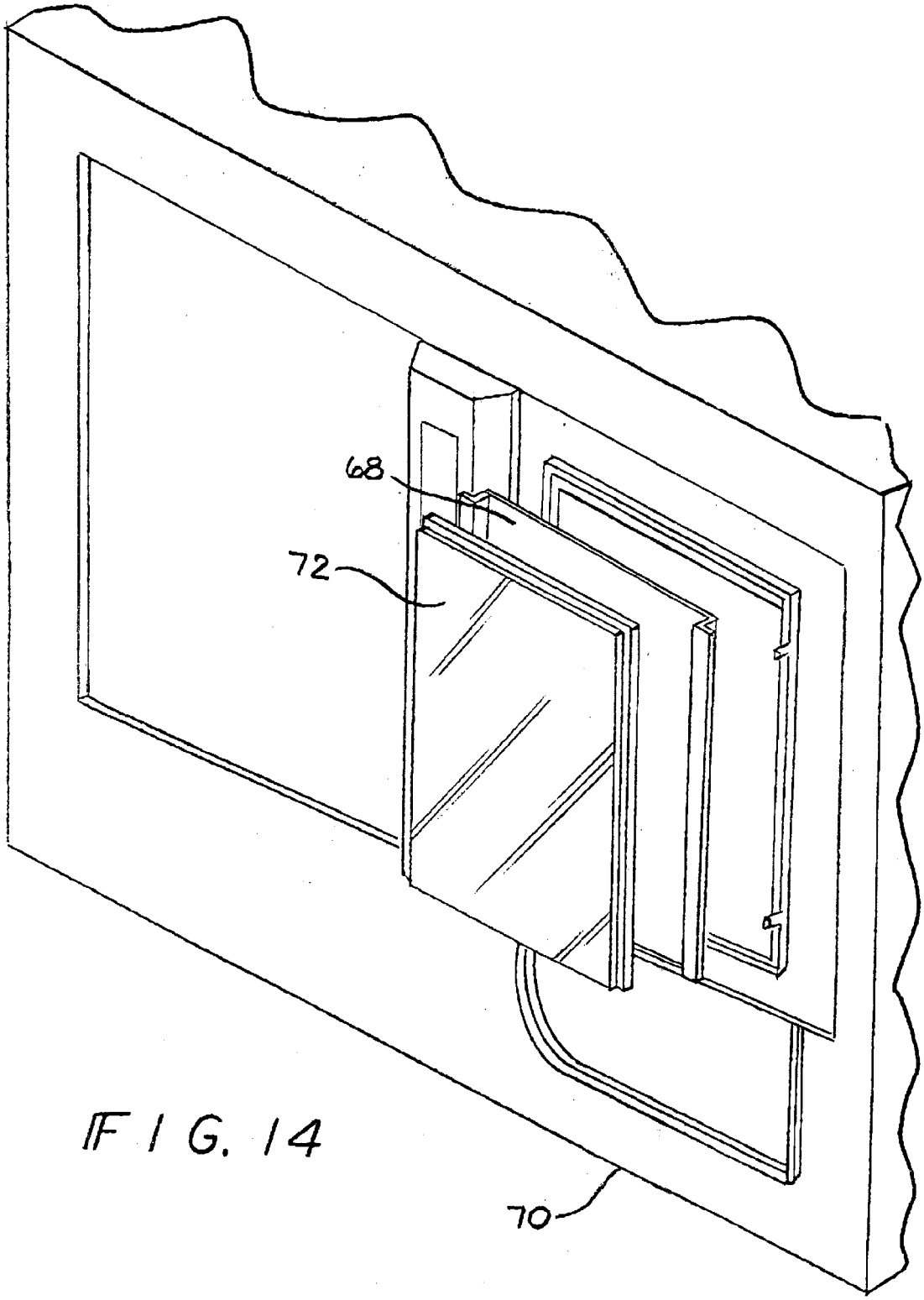
FIG. 14 is an insert molded method of coupling a window to a binder assembly.

In one embodiment of the present invention, the material used to form the windows is inserted into the mold forming the binder assembly. This is shown in FIG. 14. A back pocket 68 is first inserted into a core 70. A separate plastic sheet 72 is then inserted into the core 70. Examples of the material used to form the sheet include but are not limited to polypropylene, acrylic, and polycarbonate. After the sheet is inserted into the mold, polypropylene is shot around the sheet. The same process is performed for coupling a spine window to the binder.

In another embodiment of the present invention, a separate polypropylene sheet is ultrasonically welded to the body of the binder. In this embodiment, the material used to make the sheet is the same as the material used to make the binder. The binder portion may be formed first, or, in the alternative, the windows may be formed first and binder portion formed after the windows. Once both binder and windows are in place, the materials are ultrasonically welded by melting them at the points where the windows and the binders attach to each other.

In yet another embodiment, the separate polypropylene sheet is laser sealed to the body of the binder. Similar to the ultrasonic welding embodiment, the materials used in this laser sealing embodiment are the same for both the windows and the binder. Also, either the binder or the windows may be formed first. Once both the binder and the windows are in place, the materials are then sealed using lasers that melt the materials at the points where the windows and the binders attach to each other. Use of this embodiment provides a high degree of precision in the areas in which the materials are melted together to attach the window and the binder.

FIG. 15 shows still another embodiment. In FIG. 15, a mold 74 is opened and a film 76 is indexed between the sides of the mold. The film may have a decorated pattern. The film is made from a polypropylene material, or in the alternative any other material that is compatible with polypropylene, for example a material that has similar reaction characteristics when heat is applied. After the film 76 is placed in the mold 74, the mold then closes and polypropylene is injected behind the film, producing a binder with a window that is integrated with the binder. In one embodiment, the film 76 then falls out of the mold as a part of the binder.

In an alternate embodiment, the film may separate from the binder, leaving the film forming the windows. The film, binder and windows may be made of the same clear polypropylene material. The material used for the film may also be polyester. The film may have an image of a printed graphic for transfer onto the binder once the film is removed. Alternatively, the film may be used to provide color to the binder and thus may be a colored polypropylene material. The color is transferred from the film material to the binder when the film material is applied and removed from the binder.

An interior compartment molded to the front cover is also contemplated by the present invention. The molding of the interior compartment may be performed during the manufacturing process. The first and second window pockets may then be coupled to the inside of the binder portion. Many different coupling methods are contemplated by the present invention. One such coupling method may be performed by the heated welding of the pockets onto the binder portion. Another method may be performed by the ultrasonic welding of the pockets onto the binder portion. Yet another method is through an interlocking mechanism in which the pockets are attached to the binder by a locking assembly. It is to be understood that any of the above coupling methods may be used to couple any of the pockets to the binder portion. All of the methods may be used in the same manufacturing process.

The foregoing description of the preferred embodiments of the invention have been presented for the purposes of illustration and description. It is not intended to be exhaustive or to limit the invention to the precise form disclosed. Although the present invention has been described in detail, it should be apparent to those skilled in the art that various adaptations may be accomplished without departing from the spirit and scope of the invention. Many modifications and variations are possible in light of the above teaching. It is intended that the scope of the invention be limited not by this detailed description, but rather by the claims appended hereto.

What is claimed is:

1. A binder assembly comprising:

a front cover assembly having an inside surface, an outside surface, and a first opening, the front cover assembly including:

a first window substantially covering the first opening;

an interior compartment coupled to the inside surface of the front cover assembly; and an intermediate pocket between the first window and the interior compartment, coupled to the inside surface of the front cover assembly, the intermediate pocket having a top opening for allowing insertion of an item between the first window and the intermediate pocket so that the item is visible through the first opening in the front cover assembly; and the intermediate pocket having a center area and a hole in the area thereof;

a back cover;

a spine between the front cover assembly and the back cover hingedly coupling the front cover assembly and the back cover, the spine having an inside surface, an outside surface, a top portion, a bottom portion, and a second opening;

a second window substantially covering the second opening in the spine; and a second pocket coupled to the inside surface of the spine, the second pocket having a center area and a hole in the area thereof.

2. The binder assembly as claimed in claim 1, wherein a first living hinge couples the spine to the front cover assembly, and a second living hinge couples the spine to the back cover.

3. The binder assembly of claim 1, wherein the interior compartment is molded to the inside surface of the front cover assembly.

4. The binder assembly of claim 1, further comprising a ring portion coupled to the inside surface of said spine.

5. The binder assembly of claim 1, further comprising a flanged lip on the inside surface of the spine, positioned at the top portion of the spine.

6. The binder assembly of claim 1, further comprising a flanged lip on the inside surface of the spine, positioned at the bottom portion of the spine.

7. The binder assembly of claim 1, wherein the back cover comprises an inside surface, an outside surface, and a back cover opening, the back cover opening being substantially covered by a back cover window.

8. The binder assembly of claim 7, wherein a back interior pocket is coupled to the inside surface of the back cover.

9. The binder assembly of claim 1, wherein the front cover assembly comprises an upper opening and a lower opening, the upper opening being substantially covered by an upper window and the lower opening being substantially covered by a lower window.

10. The binder assembly of claim 1, wherein the intermediate pocket has an opening at a bottom portion.

11. The binder assembly of claim 1, wherein the intermediate pocket has a side opening.

12. The binder assembly of claim 5, wherein the second pocket comprises an opening at the bottom.

13. The binder assembly of claim 1, wherein the intermediate pocket is concave at a center of the intermediate pocket relative to the front cover assembly.

14. The binder assembly of claim 1, wherein the second pocket is concave at the center of the second pocket relative to the spine.

15. A binding cover comprising:

a cover having an inside surface, an outside surface, and a first window molded therein; and a backing layer substantially covering the first window and coupled to the inside surface of the front cover.

16. The cover as claimed in claim 15 further comprising a back cover.

17. The cover as claimed in claim 16 further comprising a spine between the front cover and the back cover hingedly coupling the front cover and the back cover, the spine having an inside surface, an outside surface, and a second window molded therein.

18. The cover as claimed in claim 15 further comprising:

an interior compartment coupled to the inside surface of the cover; and an intermediate pocket between the backing layer and the interior compartment, the intermediate pocket coupled to the inside surface of the cover.

19. The cover as claimed in claim 17 further comprising a secondary pocket coupled to the inside surface of the spine, the secondary pocket comprising:

a top portion, said secondary pocket having an opening at said top portion;

a bottom portion; and a center, said secondary pocket having a hole in said center.

20. The cover as claimed in claim 17 wherein a living hinge couples the spine to the cover and the spine to the back cover.

21. The cover as claimed in claim 17 further comprising a spine backing layer, the spine backing layer substantially covering the second window in the spine and coupled to the spine.

22. The cover as claimed in claim 17 wherein a ring portion is coupled to the inside surface of said spine.

23. A method of manufacturing a binder assembly, comprising:

injecting a first material into a first mold to form a binder, the binder comprising;

a front cover and a back cover, each cover having an inside surface and an outside surface;

a spine between the front cover and the back cover, the spine hingeably coupling the front cover to the back cover and having an inside surface; and a first hinge coupling the spine to the front cover and a second hinge coupling the spine to the back cover;

embedding a first window into the front cover;

embedding a second window into the spine;

coupling the first window to the front cover and the second window to the spine; and forming a plurality of pockets from the first window material, the plurality of pockets comprising:

an interior compartment molded to the inside surface of the front cover;

a first pocket between the first window and the interior compartment coupled to the inside surface of the front cover; and a second pocket coupled to the inside surface of the spine.

24. The method of manufacturing as claimed in claim 23, wherein the first window is made from a clear, rigid plastic material.

25. The method of manufacturing as claimed in claim 24, wherein the clear, rigid plastic material is polystyrene.

26. The method of manufacturing as claimed in claim 23, wherein the second window is made from a clear, rigid plastic material.

27. The method of manufacturing as claimed in claim 26, wherein the clear, rigid plastic material is polystyrene.

28. The method of manufacturing as claimed in claim 23, further comprising a ring portion coupled to the inside surface of said spine.

29. A method of manufacturing a binder assembly, comprising:

injecting a first material into a first mold to form a front cover window sheet and a spine window sheet;

injecting a second material into a second mold to form a binder, the binder comprising;

a front cover and a back cover, each cover having an inside surface and an outside surface;

a spine between the front cover and the back cover, the spine hingeably coupling the front cover to the back cover and having an inside surface; and a first hinge coupling the spine to the front cover and a second hinge coupling the spine to the back cover;

embedding the front cover window sheet into the front cover to form a first window;

embedding the spine window sheet into the spine to form a second window; and coupling the first window to the first cover and the second window to the spine.

30. The method of manufacturing as claimed in claim 29, wherein the first window is made from a clear, rigid plastic material.

31. The method of manufacturing as claimed in claim 30, wherein the clear, rigid plastic material is polystyrene.

32. The method of manufacturing as claimed in claim 29, wherein the second window is made from a clear, rigid plastic material.

33. The method of manufacturing as claimed in claim 32, wherein the clear, rigid plastic material is polystyrene.

34. The method of manufacturing as claimed in claim 29, further comprising forming a plurality of pockets from said first material, the plurality of pockets comprising:

an interior compartment molded to the inside surface of the front cover;

a first pocket between the first window and the interior compartment coupled to the inside surface of the front cover; and a second pocket coupled to the inside surface of the spine.

35. The method of manufacturing as claimed in claim 30, further comprising a ring portion coupled to the inside surface of said spine.

36. A method of manufacturing a binder assembly, comprising:

injecting a first material into a binder mold to form a binder portion, the binder portion comprising:

a front cover having an inside surface, an outside surface, and a first opening;

a back cover having an inside surface, an outside surface and a second opening;

a spine between the front cover and the back cover, the spine hingeably coupling the front cover to the back cover and having an inside surface; and a first hinge coupling the spine to the front cover and a second hinge coupling the spine to the back cover;

injecting said first material into a first window mold to form a first window embedded in the front cover, said first window substantially covering the first opening in the front cover;

injecting said first material into a second window mold to form a second window embedded in the front cover, said second window substantially covering the second opening in the spine; and coupling said first window to the binder portion and the second window to the binder portion.

37. The method of manufacturing as claimed in claim 36, further comprising forming a plurality of pockets from said first material, the plurality of pockets comprising:

an interior compartment molded to the inside surface of the front cover;

a first pocket between the first window and the interior compartment coupled to the inside surface of the front cover; and a second pocket coupled to the inside surface of the spine.

38. The method of manufacturing as claimed in claim 36, further comprising a ring portion coupled to the inside surface of said spine.

39. A method of coupling a window assembly to a binder portion, comprising:

constructing a binder portion, said binder portion comprising:

a front cover and a back cover, each cover having an inside surface and an outside surface;

a spine between the front cover and the back cover, the spine hingeably coupling the front cover to the back cover and having an inside surface; and a first hinge coupling the spine to the front cover and a second hinge coupling the spine to the back cover;

constructing a window assembly, said window assembly comprising:

a first window;

a second window;

a first window pocket; and a second window pocket;

embedding the first window into the front cover of the binder portion;

embedding the second window into the spine of the binder portion;

coupling the first window pocket to the inside surface of the front cover; and coupling the second window pocket to the inside surface of the spine.

40. The method of coupling as claimed in claim 39, wherein the window assembly further comprises an interior compartment over the first pocket, said interior compartment being molded to the inside surface of the front cover.

41. The method of coupling of claim 39, wherein coupling said first and second window pockets is performed by heat welding.

42. The method of coupling of claim 39, wherein coupling said first and second window pockets is performed by ultrasonic welding.

43. The method of coupling of claim 39, wherein coupling said firsthand second window pockets is performed by an interlocking mechanism.

44. The method of coupling of claim 39, wherein coupling said first and second window pockets is performed by laser sealing.

45. A method of coupling a window assembly to a binder portion, comprising:

embedding a first window into a front cover of a binder portion, the first window substantially covering a first opening in the front cover, the binder portion also including:

a back cover, the back cover and the front cover each having an inside surface and an outside surface;

a spine between the front cover and the back cover, the spine hingeably coupling the front cover to the back cover; and a first hinge coupling the spine to the front cover and a second hinge coupling the spine to the back cover;

embedding a second window into the spine of the binder portion;

coupling a first window pocket to the inside surface of the front cover; and coupling a second window pocket to an inside surface of the spine.

46. A binder assembly comprising:

a structural front cover panel having an interior surface, an exterior surface, and a first window molded therein;

an interior pocket molded to the interior surface of the structural front cover panel to form a first opening between the structural front cover panel and the interior pocket for inserting material between the interior surface of the structural front cover panel and the interior pocket so that the material is visible through the first window from the exterior surface of the structural front cover panel, wherein the structural front cover panel, the first window, and the interior pocket are molded together as part of a single-piece construction; and a structural back cover panel coupled to the structural front cover panel.

47. A binder assembly comprising:

a structural front cover panel;

a structural back cover panel coupled to the structural front cover panel;

a spine panel between the structural front cover panel and the structural back cover panel hingedly coupling the structural front cover panel and the structural back cover panel, the spine panel having an interior surface, an exterior surface, and a window molded therein; and a spine pocket molded to the interior surface of the spine panel to form an opening between the spine panel and the spine pocket for inserting material between the interior surface of the spine panel and the spine pocket so that the material is visible through the window from the exterior surface of the spine panel.

* * * * *